US010794349B2

(12) United States Patent
Rehwald et al.

(10) Patent No.: US 10,794,349 B2
(45) **Date of Patent: *Oct. 6, 2020**

(54) INJECTION SYSTEM, IN PARTICULAR FUEL INJECTION SYSTEM, HAVING A FLUID-CONVEYING COMPONENT, A METERING VALVE, AND A MOUNTING SYSTEM

(71) Applicant: Robert Bosch GmbH, Stuttgart (DE)

(72) Inventors: Andreas Rehwald, Bietigheim-Bissingen (DE); Prakash Gurushantappa Yadawad, Stuttgart (DE); Rao Bharath Narahari, Mysuru (IN); Sunil Makarabbi, Haveri (IN)

(73) Assignee: Robert Bosch GmbH, Stuttgart (DE)

( * ) Notice: Subject to any disclaimer, the term of this patent is extended or adjusted under 35 U.S.C. 154(b) by 6 days.

This patent is subject to a terminal disclaimer.

(21) Appl. No.: 16/179,547

(22) Filed: Nov. 2, 2018

(65) Prior Publication Data

US 2019/0136812 A1 May 9, 2019

(30) Foreign Application Priority Data

Nov. 6, 2017 (DE) ..... 10 2017 219 626

(51) Int. Cl.
*F02M 51/00* (2006.01)
*F02M 61/14* (2006.01)
(Continued)

(52) U.S. Cl.
CPC ..... *F02M 61/14* (2013.01); *F02M 55/025* (2013.01); *F02M 61/166* (2013.01); *F02M 2200/09* (2013.01); *F02M 2200/853* (2013.01)

(58) Field of Classification Search
CPC ..... F02M 61/14; F02M 2200/09; F02M 2200/856; F02B 1/02
(Continued)

(56) References Cited

U.S. PATENT DOCUMENTS 10,174,734 B2 * 1/2019 Reinhardt ..... F02M 61/14
2015/0345445 A1 * 12/2015 Reinhardt ..... F02M 55/02 239/584

(Continued)

FOREIGN PATENT DOCUMENTS

DE 102013200993 A1 7/2014

*Primary Examiner* — John Kwon
(74) *Attorney, Agent, or Firm* — Norton Rose Fulbright US LLP; Gerard Messina

(57) ABSTRACT

A mounting system for fuel injection systems connects a fuel injection valve to a fluid-conveying component and includes a connector piece of the metering valve being inserted at least partly into a receiving space of a connector body of the component; a support part disposed on the connector piece; a decoupling element; a dished disk inserted into a receiving space of the connector body and immobilized along a longitudinal axis of the receiving space relative to the connector body. The support part has a spherical support surface that faces toward a dished surface of the dished disk. The decoupling element is disposed between the spherical support surface of the support part and the dished disk. The connector piece is mounted on the connector body via the support part, decoupling element, and dished disk.

18 Claims, 6 Drawing Sheets

(51) Int. Cl.
*F02M 55/02* (2006.01)
*F02M 61/16* (2006.01)

(58) Field of Classification Search
USPC ..... 123/490; 239/97, 102, 585.1
See application file for complete search history.

(56) References Cited

U.S. PATENT DOCUMENTS

| | | | | |
|---|---|---|---|---|
| 2016/0003205 | A1* | 1/2016 | Reinhardt | F02M 61/14<br>123/470 |
| 2019/0136811 | A1* | 5/2019 | Rehwald | F02M 61/14 |
| 2019/0136813 | A1* | 5/2019 | Rehwald | F02M 61/04 |

* cited by examiner

INJECTION SYSTEM, IN PARTICULAR FUEL INJECTION SYSTEM, HAVING A FLUID-CONVEYING COMPONENT, A METERING VALVE, AND A MOUNTING SYSTEM

CROSS-REFERENCE TO RELATED APPLICATIONS

The present application claims priority under 35 U.S.C. § 119 to DE 10 2017 219 626.2, filed in the Federal Republic of Germany on Nov. 6, 2017, the content of which is hereby incorporated by reference herein in its entirety.

FIELD OF THE INVENTION

The present invention relates to a mounting system for injection systems, in particular fuel injection systems, for connecting a metering valve to a fluid-conveying component; and to an injection system having such a mounting system. The invention relates in particular to the field of fuel injection systems for mixture-compressing spark-ignited internal combustion engines.

BACKGROUND

DE 10 2013 200 993 A1 discloses a fuel injection system having a fuel-conveying component, a fuel injection valve, and a mounting system. In the known mounting system, a receiving space, in which a fuel fitting of the fuel injection valve is disposed, is provided inside a cup of the fuel-conveying component. An internal collar is configured on the cup. Also provided is an elastically deformable element that is braced against the internal collar. The fuel fitting is then braced via the elastically deformable element. Mounting of the fuel injection valve on the fuel-conveying component is thereby possible, a reduction in noise being possible as a result of targeted decoupling.

Reducing engine noise is important nowadays not only in terms of noise perceptible in the vehicle interior. In the context of a sales discussion, certain engine noises can be perceived by a customer as undesirable when the engine is idling, especially with the hood open. This relates in particular to metallic transitions in the context of the fuel injection valve mounting system. It can furthermore be assumed that as fuel injection pressure increases, such undesired noises will be at least subjectively perceived to be louder.

SUMMARY

Example embodiments of the present invention provide improved mounting of a metering valve on a fluid-conveying component. In particular, improved installation at least with reference to suitable application instances can be achieved.

The mounting system and the injection system are suitable especially for applications for fuel injection, in particular direct gasoline injection. The fluid-conveying component is then embodied as a fuel-conveying component. The metering valve is then embodied as a fuel injection valve. Advantages and refinements described with reference to these preferred applications can, however, also correspondingly be utilized generally in a mounting system for injection systems and in injection systems.

The fuel-conveying component is preferably embodied for that purpose as a fuel distributor, in particular as a fuel distributor rail. A fuel distributor of this kind can serve on the one hand to distribute fuel to several fuel injection valves, in particular high-pressure injection valves. On the other hand, the fuel distributor can serve as a common fuel reservoir for the fuel injection valves. The fuel injection valves are then preferably connected to the fuel distributor via corresponding mounting systems. During operation, the fuel injection valves then inject the fuel necessary for the combustion operation, at high pressure, into the respective combustion chamber. The fuel is compressed via a high-pressure pump and delivered into the fuel distributor in quantitatively controlled fashion via a high-pressure conduit.

The support part disposed on the connector piece is preferably embodied as a separate support part that can be connected in suitable fashion to the connector piece of the injection valve. In principle, the support part can also be a constituent of the connector piece. The connector piece is thus not necessarily a constituent of a mounting system according to the present invention. In particular, a mounting system according to the present invention can, if applicable, also be manufactured and marketed separately from the fuel injection valve. The connector body can be a constituent of the fuel-conveying component. In particular, the connector body can be configured as a cup of a fuel distributor. The connector body can, however, also be connected at a later time to a basic body of a fuel distributor, for example by welding. A mounting system according to the present invention can thus, if applicable, also be manufactured and marketed independently of such further components, in particular a basic body, of the fuel-conveying component.

A dished disk is configured so that its dished surface is part of a sphere surface or part of a surface of a sphere segment. The spherical support surface is correspondingly embodied respectively as part of a sphere surface or as part of a surface of a sphere segment. The decoupling element preferably abuts at least largely against the entire dished surface of the dished disk and/or at least largely against the entire spherical support surface of the support part. The local mechanical load is thereby reduced. Improved geometrical alignment and bracing in different spatial directions can also be achieved. In particular, advantageous alignment and bracing of the fuel injection valve with reference to a longitudinal axis predefined by the connector body can be enabled. This also results in improved positioning in, for example, a cylinder orifice of the internal combustion engine.

A result that can be obtained thereby in particular is that a direct transfer path between the fuel injection valve and a cylinder head is absent. Fastening means between the fuel injection valve and the cylinder head, for example bolts that are inserted into elastic bearing bushings for noise insulation, can thereby also be absent.

An example embodiment of the present invention enables simple installation of the fuel injection valve. Upon insertion of the connector piece of the fuel injection valve into the receiving space of the connector body, the dished disk can also be inserted into the receiving space and then immobilized in simple fashion. This results in fastening of the connector piece to the connector body of the component. Together with the fuel pressure that acts during operation, reliable immobilization of the fuel injection valve is then produced because forces acting on the connector piece by way of the fuel pressure are absorbed via the dished disk connected to the connector body. According to an example embodiment, the retaining element in particular can be configured in at least approximately a U-shape.

According to an example embodiment, an at least approximately constant thickness of the decoupling element in the unloaded state can be defined. According to an example embodiment, the decoupling element is advantageously constituted at least partly from at least one elastomer. The decoupling element can be shaped at least partly as a net-shape shaped part, in particular as a plastic injection-molded part, a thermoplastic elastomer part, a natural rubber part, or a synthetic rubber part, and/or can be cut out from a strip- or plate-shaped precursor material and/or shaped in another manner.

Additionally or alternatively, the decoupling element can be constituted at least partly from a thermoplastic material or a curable plastic material. In particular, the decoupling element can advantageously have, in accordance with an example embodiment, a layered structure, in particular a sandwich structure. A layered structure is not necessarily limited in this context to two or three layers. A layered structure in which an elastic layer is located between two non-elastic layers is nevertheless advantageous. According to an example embodiment, an advantage is provided that not only good robustness but also an advantageous damping effect can be achieved.

An example embodiment provides an advantage that a solid and robust configuration of the decoupling element is possible.

According to an example embodiment, at least one groove and/or at least one slit and/or at least one preferably tangential orifice is provided on the dished surface.

Preferred exemplifying embodiments of the invention are explained in further detail in the description below with reference to the appended drawings, in which corresponding elements are labeled with matching reference characters.

DETAILED DESCRIPTION

Figure 1:
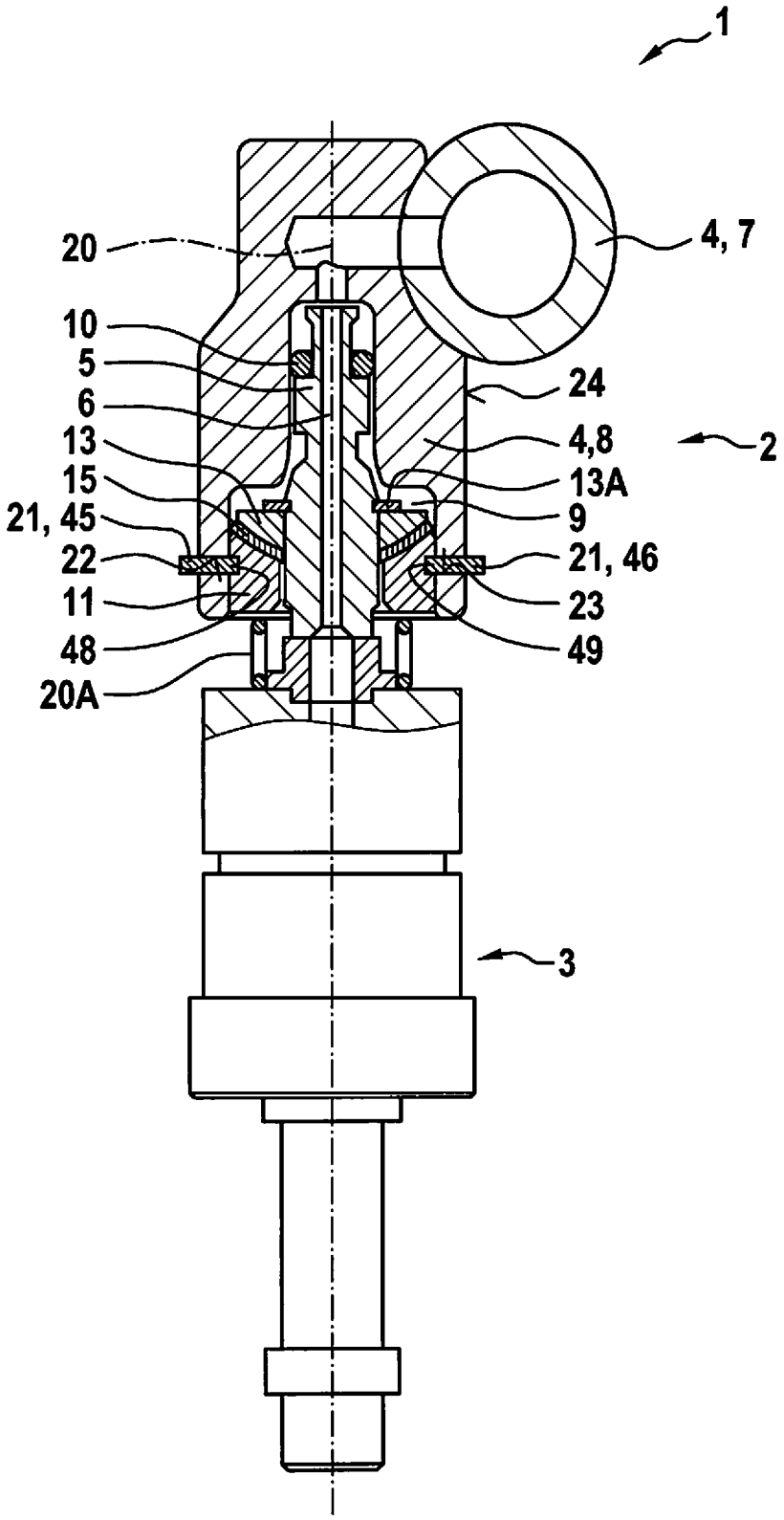
FIG. 1 is a partial schematic sectioned depiction of a fuel injection system having a mounting system, according to an example embodiment of the present invention.

FIG. 1 is a partial schematic sectioned depiction of a fuel injection system 1 having a mounting system 2, in accordance with an exemplifying embodiment. Fuel injection system 1 has a fuel injection valve 3 and a fuel-conveying component 4. Fuel injection valve 3 has a connector piece 5 that encompasses an axial passthrough orifice 6 in order to convey fuel into fuel injection valve 3. In this exemplifying embodiment, fuel-conveying component 4 has a tubular basic body 7 and a connector body 8. In this exemplifying embodiment, connector body 8 is embodied as a cup 8 and has a receiving space 9.

Connector piece 5 is inserted at least partly into receiving space 9 of connector body 8. Fuel sealing is ensured in this context by way of a sealing ring 10.

A dished disk 11, on which a dished surface 12 (FIG. 7) is embodied, is furthermore inserted into receiving space 9. In this exemplifying embodiment, a support part 13 that is connected to connector piece 5 is furthermore disposed on connector piece 5. This can be accomplished by way of at least one support part fastening means 13A that is embodied in particular as an expanding ring 13A. In a modified embodiment, support part 13 can in principle also be a constituent of connector piece 5. A spherical support surface 14 (FIG. 6), which faces toward dished surface 12, is embodied on support part 13.

In the installed state, a decoupling element 15 is disposed between dished surface 12 of dished disk 11 and spherical support surface 14 of support part 13. Decoupling element 15 preferably abuts substantially against the entire dished surface 12 and/or at least substantially against the entire spherical support surface 14, so that full-coverage abutment of decoupling element 15 on both sides, respectively against dished surface 12 and spherical support surface 14, is produced.

In the installed state, fuel injection valve 3 is then aligned with reference to a longitudinal axis 20, predefined by connector body 8, of receiving space 9. Reliable positioning of fuel injection valve 3 in a cylinder-head orifice can correspondingly be accomplished, for example. Mounting system 2 makes additional fastening or bracing (by way of a metallic contact) of fuel injection valve 3 against the cylinder head superfluous. Transfer of vibrations between fuel injection valve 3 and the cylinder head is thereby, in particular, avoided. Insulation of fuel injection valve 3 from connector body 8 and thus from fuel-conveying component 4 is furthermore provided by decoupling element 15. This reduces or prevents, in particular, the transmission of solid-borne sound. An elastic retaining clamp 20A, which is disposed between connector body 8 and fuel injection valve 3, can be provided.

In this exemplifying embodiment, immobilization of dished disk 11 on connector body 8 is accomplished via a retaining element 21. Connector body 8 has openings 22, 23. Retaining element 21 can thereby be installed from outer side 24. In the installed state, retaining element 21 engages through openings 22, 23 into at least one recess 25 (FIG. 7) of dished disk 11. Immobilization of dished disk 11 along longitudinal axis 20 is thereby ensured by way of retaining element 21. Simple installation (and removal) of fuel injection valve 3 on component 4 by way of mounting system 2 is thereby enabled.

Figure 2:
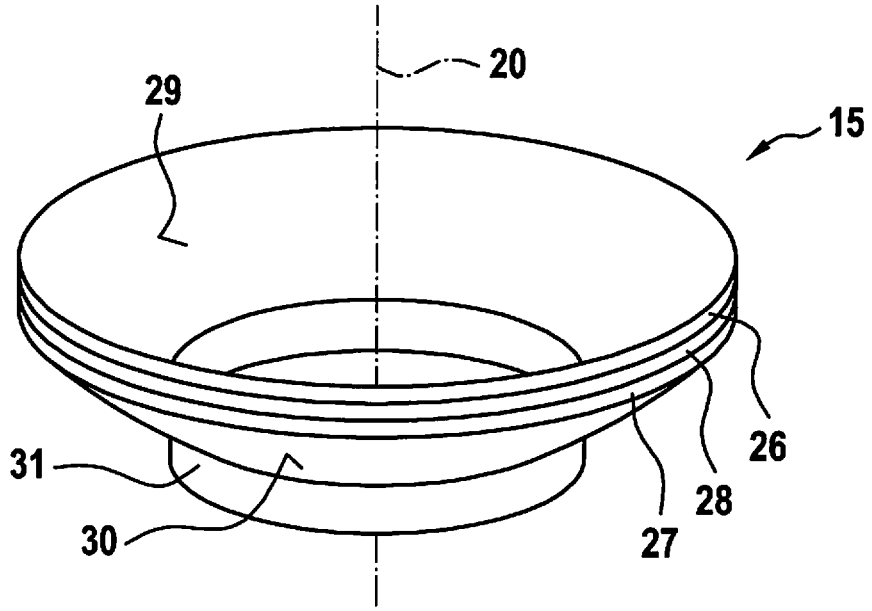
FIG. 2 shows a decoupling element of the mounting system depicted in FIG. 1, according to an example embodiment of the present invention.

FIG. 2 is a schematic three-dimensional depiction of a decoupling element 15 of the mounting system depicted in FIG. 1, in accordance with a first possible embodiment. In this embodiment, layers 26, 27, 28 are provided. Layer 28 is preferably embodied as an elastic intermediate layer in order to enable a sandwich structure. Layer 26 serves here as a first outer layer 26, and layer 27 serves as a second outer layer 27. Layers 26, 27 are preferably embodied as metallic layers 26, 27 and/or as at least substantially inelastic plastic layers. Improved stability at an outer side 29 of layer 26 and at an outer side 30 of layer 27 can thereby, in particular, be achieved. Outer side 29 abuts in the installed state against spherical support surface 14 of support part 13. Outer side 30 abuts in the installed state against dished surface 12 of dished disk 11. A collar 31, which surrounds connector piece 5 in portions in the installed state, can also be shaped onto decoupling element 15 in order also to ensure insulation with respect to dished disk 11 in a radial direction with reference to longitudinal axis 20. Collar 31 can furthermore ensure positioning of decoupling element 15 on dished disk 11.

Figure 3:
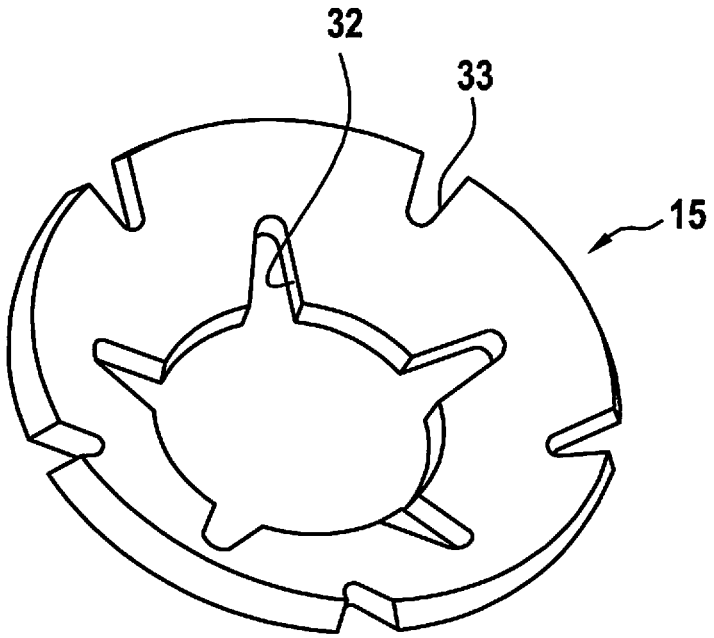
FIG. 3 shows a decoupling element of the mounting system depicted in FIG. 1, according to another example embodiment of the present invention.

FIG. 3 shows the decoupling element depicted in FIG. 2 in accordance with a second possible embodiment. In this embodiment, decoupling element 15 is configured as a metallic spring element 15. Recesses 32, 33 (only recesses 32, 33 of which are labeled in order to simplify the depiction) can be provided on decoupling element 15 in addition to a three-dimensional configuration in order to define the elastic effect desired in the particular application instance, in particular a spring constant.

Figure 4:
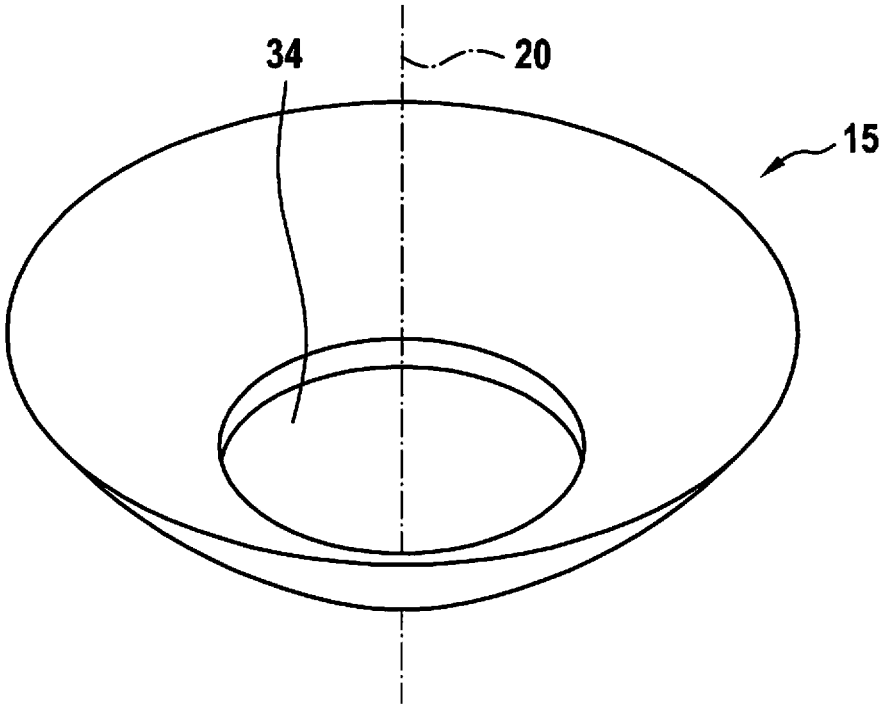
FIG. 4 shows a decoupling element of the mounting system depicted in FIG. 1, according to another example embodiment of the present invention.

FIG. 4 shows the decoupling element depicted in FIG. 2 in accordance with a third possible configuration. Decoupling element 15 can be configured here, for example, as a shaped element generated in a tool. An axial opening 34, which can be of circular configuration and is oriented with reference to longitudinal axis 20 defined in the installed state, can also be embodied, for example, by punching.

Several possibilities therefore exist for configuring a decoupling element 15 in terms of the respective application instance. A layered structure having two or more layers, one of which is described with reference to FIG. 2, can be implemented. Different materials can thereby advantageously be combined. For example, metallic materials and plastics can be combined. A thermoplastic, a thermoplastic elastomer, a natural rubber, and a synthetic rubber can be utilized for an elastic layer, in particular an elastic intermediate layer as explained in FIG. 2 with reference to layer 28, or also in the context of an embodiment made of a single material as described with reference to FIG. 4. A (non-layered) material composition can also be used as a material in this context. In addition, decoupling element 15 does not necessarily need to be installed as a separate component upon installation. Decoupling element 15 can, in particular, already be joined onto dished disk 11. Intermaterial connection or injection application of decoupling element 15 onto dished disk 11 is also conceivable. Decoupling element 15 can also, if applicable in interaction with an elastic sealing ring 10, make possible a certain tolerance compensation for positional deviations of fuel injection valve 3 from longitudinal axis 20. This relates in particular to tilts and to a coaxial offset. Damage to fuel injection valve 3 as a result of flexural forces or the like is thus prevented.

Figure 5:
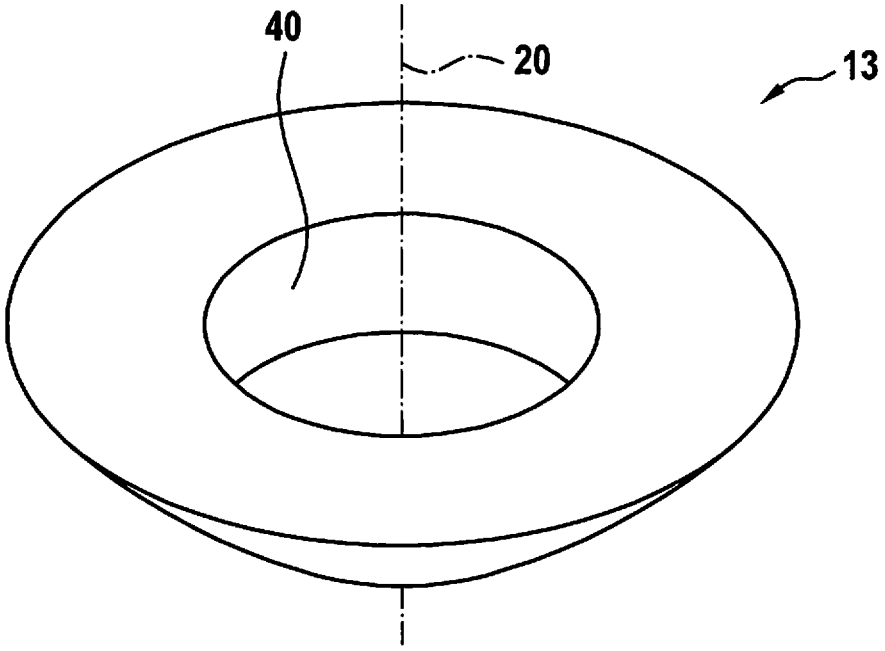
FIG. 5 shows a support part of the mounting system depicted in FIG. 1, according to an example embodiment of the present invention.

FIG. 5 shows support part 13 of mounting system 2 depicted in FIG. 1, in accordance with a possible embodiment. Support part 13 has a passthrough orifice 40 through which connector piece 5 of fuel injection valve 3 extends in the installed state. Passthrough orifice 40 is configured as an axial passthrough orifice 40 with reference to longitudinal axis 20 predefined by installation. In this exemplifying embodiment, support part 13 is configured annularly with reference to longitudinal axis 20.

Figure 6:
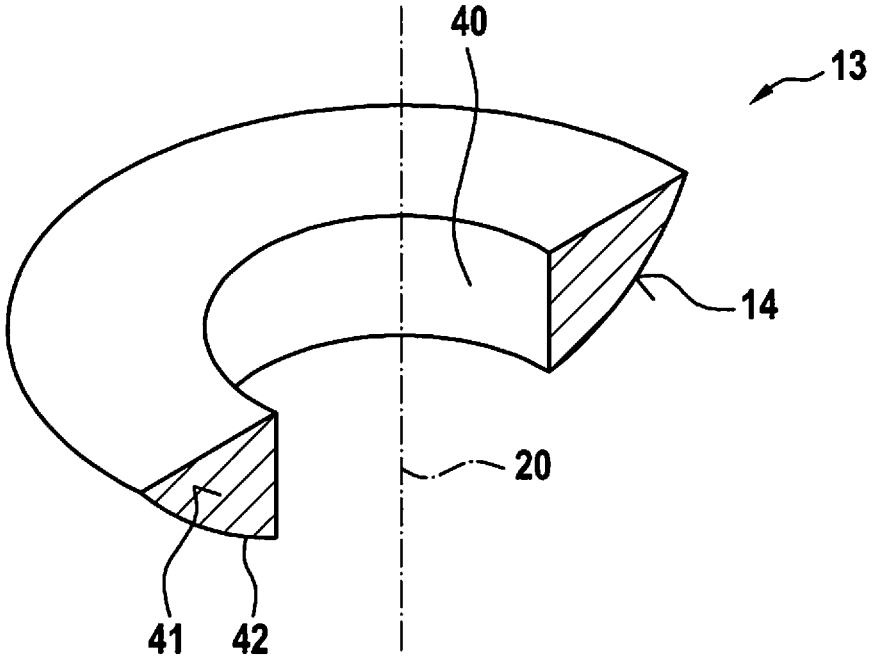
FIG. 6 is a three-dimensional sectioned depiction of the support part depicted in FIG. 5, a longitudinal axis being located in the section plane, according to an example embodiment of the present invention.

FIG. 6 is a three-dimensional sectioned depiction of support part 13 depicted in FIG. 5, longitudinal axis 20 being located in the section plane. Support part 13 is preferably configured with a profile 41 that is uniform in a circumferential direction. A side 42 of profile 41 which adjoins spherical support surface 14 is then embodied in the shape of a circular arc.

Figure 7:
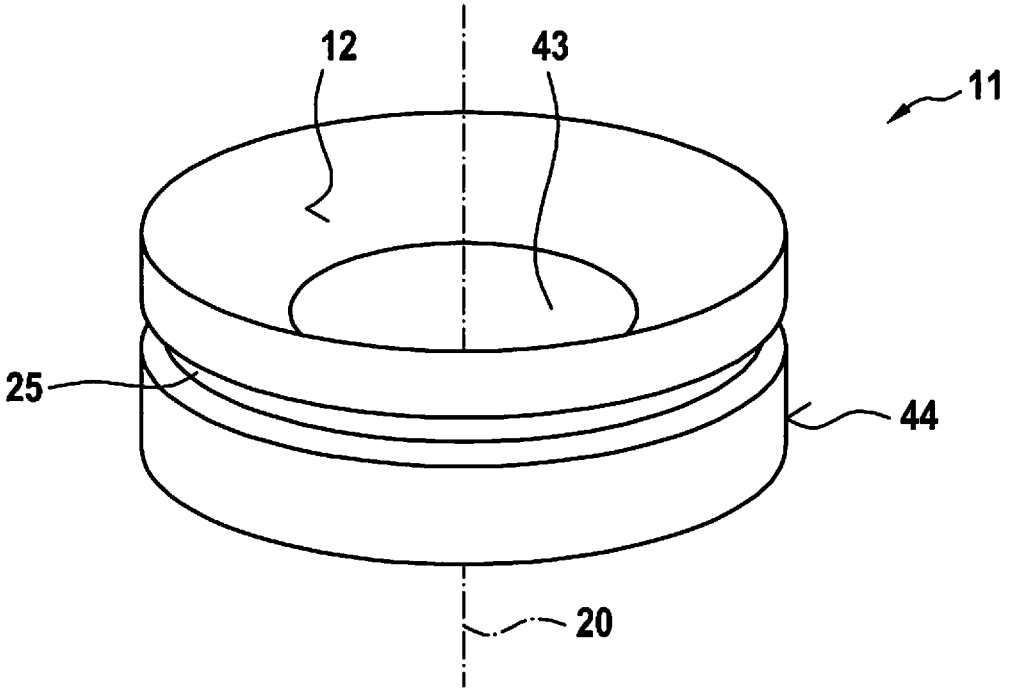
FIG. 7 shows a dished disk of the mounting system depicted in FIG. 1, according to an example embodiment of the present invention.

FIG. 7 is a schematic three-dimensional depiction of dished disk 11 of mounting system 2 depicted in FIG. 1, according to a preferred embodiment. Dished disk 11 can be based on a cylindrical basic body. Dished surface 12 is configured as part of a spherical surface. Dished surface 12 is configured symmetrically with reference to longitudinal axis 20. Dished disk 11 furthermore has an orifice 43, embodied as a passthrough orifice 43, which extends along longitudinal axis 20 and through which, in the installed state, connector piece 5 of fuel injection valve 3 extends. Recess 25, in the form of a circumferentially surrounding groove, is configured on an outer side 44, disposed in the installed state inside receiving space 9 of connector body 8, of dished disk 11.

Figure 8:
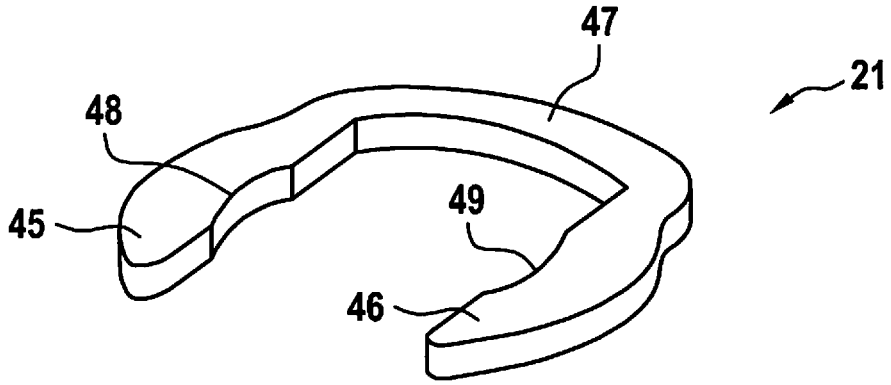
FIG. 8 shows a retaining element of the mounting system depicted in FIG. 1, according to an example embodiment of the present invention.

FIG. 8 is a schematic three-dimensional depiction of retaining element 21 of mounting system 2 depicted in FIG. 1, in accordance with a first possible embodiment. In this exemplifying embodiment, retaining element 21 has a first arm 45 and a second arm 46. Retaining element 21 furthermore has a connecting shackle 47 by way of which arms 45, 46 are connected to one another. In the installed state, connecting shackle 47 is located outside connector body 8. A part 48 and a part 49, each in the form of an annular disk part 48, 49, are respectively configured on arms 45, 46. Parts 48, 49 of arms 45, 46 engage in the installed state into recess 25 of dished disk 11. A certain elastic deformability can be predefined in particular by connecting shackle 47 in order to spread arms 45, 46 apart from each other.

Figure 9:
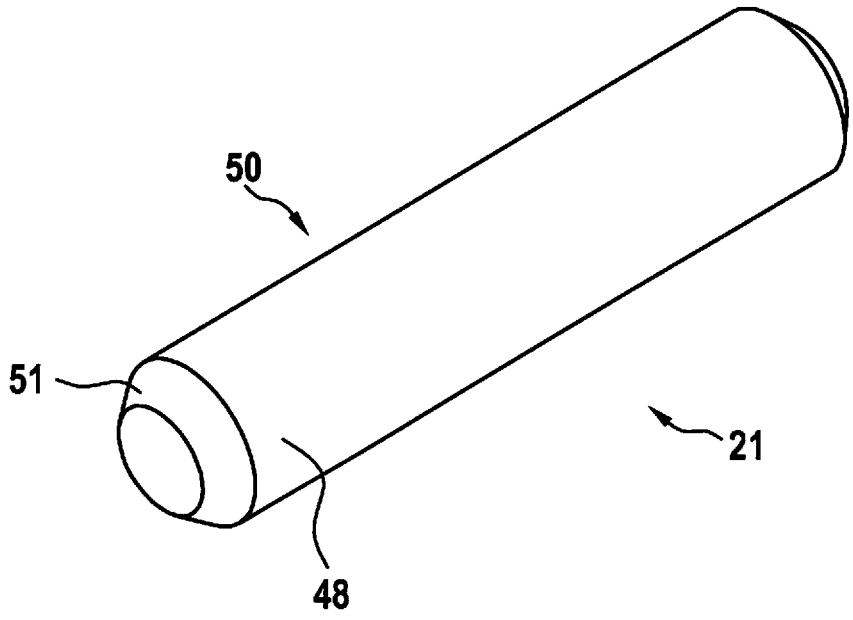
FIG. 9 shows a retaining element of the mounting system depicted in FIG. 1, according to another example embodiment of the present invention.

FIG. 9 is a schematic three-dimensional depiction of retaining element 21 of mounting system 2 depicted in FIG. 1, in accordance with a second possible exemplifying embodiment. In this exemplifying embodiment, retaining element 21 is based on a peg-shaped configuration, a bevel 51 being provided on a cylindrical basic body 50 in this exemplifying embodiment. Openings 22, 23 (FIG. 1) of connector body 8 can be configured, for example, as orifices. Retaining element 21 can then be inserted, with bevel 51 at the front, through such an opening 22, 23 in order to engage in the installed state into recess 25 of dished disk 11. One or several further such retaining elements 21 can correspondingly be provided when a corresponding number of openings 21, 22 are configured in connector body 8.

Figure 10:
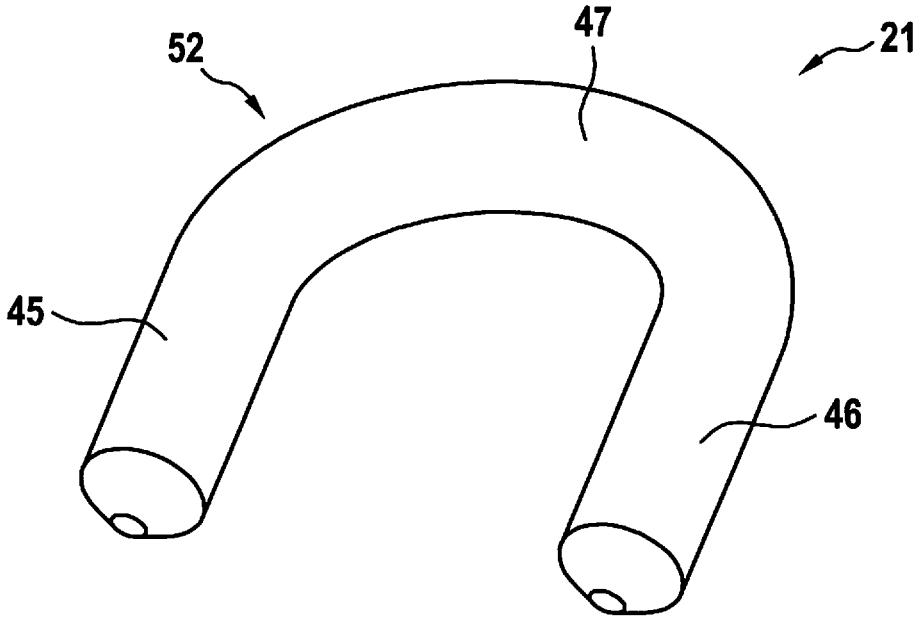
FIG. 10 shows a retaining element of the mounting system depicted in FIG. 1, according to another example embodiment of the present invention.

FIG. 10 is a schematic three-dimensional depiction of retaining element 21 of mounting system 2 depicted in FIG. 1, in accordance with a third possible embodiment. In this embodiment, retaining element 21 is based on a shackle-shaped basic shape 52 having a connecting shackle 47 and arms 45, 46. In the installed state, connecting shackle 47 can then be located outside connector body 8, and arms 45, 46 engage at least partly into recess 25. Corresponding orifices can be configured in connector body 8, four openings 22, 23 in particular being capable of being constituted in order to enable installation of retaining element 21.

A variety of modifications are possible in terms of the configuration of fuel injection system 1 and of mounting system 2. For example, support part 13 can be connected in suitable fashion to connector piece 5 of fuel injection valve 3. Pressing on, welding, or soldering are possible. A loose or detachable connection is, however, also possible. It is also conceivable in this context for the position along longitudinal axis 20 to be adjustable within certain limits and then immobilizable.

In a modified configuration, support part 13 can also have a flat or conical support surface 14. Instead of a dished disk 11, a support disk 11' that has a respectively flat or conical support disk surface 12' is then correspondingly provided. Support part 13 can furthermore be not only annularly configured. In particular, support part 13 can also be configured in the form of a partial ring or several ring parts in order to enable lateral fitting onto connector piece 5 with reference to longitudinal axis 20.

The invention is not limited to the embodiments described.

What is claimed is:

1. A mounting system for connecting a metering valve to a fluid-conveyor, the mounting system comprising:

a disk that is insertable at least partly into a receiving space of a connector body of the fluid-conveyor along a longitudinal axis of the receiving space to a position at which the disk is immobilized relative to the connector body with respect to a direction of extension of the longitudinal axis;

a support that includes a support surface that faces toward a surface of the disk;

a decoupler disposed between the support surface of the support and the surface of the disk towards which the support surface of the support faces; and a connector on which the support is disposed and that:

is connectable to the metering valve;

is insertable at least partly into the receiving space of the connector body; and is mountable to the connector body via (a) the support, (b) the decoupler, and (c) the disk.

2. The mounting system of claim 1, wherein the support surface of the support is spherical, and the surface of the disk towards which the support surface of the support faces is a concave surface.

3. The mounting system of claim 1, wherein the support surface of the support is flat, and the surface of the disk towards which the support surface of the support faces is flat.

4. The mounting system of claim 1, wherein the support surface of the support is conical, and the surface of the disk towards which the support surface of the support faces is conical.

5. The mounting system of claim 1, further comprising a retainer, wherein a radially exterior side of the disk includes a recess, and each of the at least one part of the retainer is insertable to extend through a respective corresponding opening in the connector body and engage the recess.

6. The mounting system of claim 2, wherein the at least one part is annularly shaped.

7. The mounting system of claim 5, wherein the decoupler is designed as part of a hollow sphere (15).

8. The mounting system of claim 5, wherein the decoupler is designed as part of a perforated hollow sphere cap.

9. The mounting system of claim 1, wherein the decoupler is constituted at least in part of an elastic material.

10. The mounting system of claim 1, wherein the decoupler has a layered structure.

11. The mounting system of claim 1, wherein the decoupler has a layered sandwich structure that includes at least one elastic intermediate layer.

12. The mounting system of claim 11, wherein:

the decoupler includes a first outer metallic or at least substantially inelastic plastic layer and a second outer metallic or at least substantially inelastic plastic layer; and the elastic intermediate layer is disposed between the first and second outer layers.

13. The mounting system of claim 1, wherein the decoupler is a metallic spring.

14. The mounting system of claim 1, wherein the surface of the disk towards which the support surface of the support faces is configured as an at least partly structured concave surface.

15. The mounting system of claim 1, wherein the metering valve and fluid-conveyor are part of an injection system.

16. The mounting system of claim 1, wherein the metering valve and fluid-conveyor are part of a fuel injection system.

17. An injection system comprising:

a metering valve;

a fluid-conveyor that includes a connector body within which there is a receiving space; and a mounting system via which the metering valve is mounted to the fluid-conveyor, the mounting system including:

a disk inserted at least partly into the receiving space along a longitudinal axis of the receiving space and is immobilized relative to the connector body with respect to a direction of extension of the longitudinal axis;

a support that includes a support surface that faces toward a surface of the disk;

a decoupler disposed between the support surface of the support and the surface of the disk towards which the support surface of the support faces; and a connector on which the support is disposed, and that:

is connected to the metering valve;

is inserted at least partly into the receiving space of the connector body; and is mounted to the connector body via (a) the support, (b) the decoupler, and (c) the disk.

18. The injection system of claim 17, wherein the injection system is configured for fuel injection in a mixture-compressing spark-ignited internal combustion engine.

* * * * *